US008783547B2

(12) United States Patent
Tabor

(10) Patent No.: US 8,783,547 B2
(45) Date of Patent: Jul. 22, 2014

(54) CORRUGATED PAPER STRUCTURE

(75) Inventor: Brad Tabor, Springfield, MO (US)

(73) Assignee: Southern Missouri Containers, Inc., Springfield, MO (US)

( * ) Notice: Subject to any disclaimer, the term of this patent is extended or adjusted under 35 U.S.C. 154(b) by 196 days.

(21) Appl. No.: 13/370,014

(22) Filed: Feb. 9, 2012

(65) Prior Publication Data

US 2013/0206826 A1 Aug. 15, 2013

(51) Int. Cl.
*B65D 5/00* (2006.01)
*B65B 3/02* (2006.01)

(52) U.S. Cl.
USPC ..... 229/100; 108/51.3

(58) Field of Classification Search
CPC ..... B65D 2519/00019; B65D 2519/00054; B65D 2519/00288; B65D 2519/00318; B65D 2519/00373; B65D 19/385; B65D 19/40
USPC ..... 229/100, 120.35, 120.02
See application file for complete search history.

(56) References Cited

U.S. PATENT DOCUMENTS

| | | | | |
|---|---|---|---|---|
| 1,178,675 | A * | 4/1916 | Potter | 229/120.23 |
| 2,444,183 | A * | 6/1948 | Cahners | 108/51.3 |
| 3,951,730 | A * | 4/1976 | Wennberg et al. | 428/116 |
| 5,383,409 | A | 1/1995 | Hayakawa | |
| 5,528,994 | A | 6/1996 | Iseli | |
| 5,996,510 | A | 12/1999 | Harpman et al. | |
| 6,106,451 | A | 8/2000 | Andreasson | |
| 6,948,434 | B2 | 9/2005 | Horiuchi | |
| 2002/0088378 | A1 * | 7/2002 | Simms | 108/51.3 |
| 2007/0151488 | A1 | 7/2007 | Schader | |
| 2009/0223421 | A1 | 9/2009 | Ferguson | |

* cited by examiner

*Primary Examiner* — Gary Elkins
*Assistant Examiner* — Christopher Demeree
(74) *Attorney, Agent, or Firm* — Lathrop & Gage LLP

(57) ABSTRACT

A corrugated paper structure is described for providing improved impact resistant packaging products. The corrugated paper structure comprises a plurality of structural members attached to base pads for forming a packaging product. The structural members are formed from a tube of corrugated paper with a rectangular cross-section and a truss member disposed therein.

5 Claims, 5 Drawing Sheets

CORRUGATED PAPER STRUCTURE

BACKGROUND

The present invention described herein relates to structures formed from corrugated paper. The corrugated paper structures may be used for packaging items for storage or transportation. The corrugated paper structures are relatively inexpensive to produce, and provide superior protection from damage for items stored using the corrugated paper structure.

Corrugated paper has been used to create a wide variety of structures for storing and transporting items. The strength and protective capability of a corrugated paper structure varies depending on the specific design of the structure. For example, simple corrugated paper boxes are well known but, without additional packing structures inside the box, they provide little protection to their contents from damage from dropping or other impact or crushing forces.

Often corrugated paper structures that are designed to provide higher levels of damage protection for their contents are complex in design or require components designed to protect a specific item. The corrugated paper structure described has a structure that may be utilized to encase and protect a variety of items.

SUMMARY OF THE INVENTION

The corrugated paper structure comprises a first and second base pad of corrugated paper; at least one structural member comprising a corrugated paper tube with a rectangular cross-section and a corrugated paper truss member disposed diagonally within the corrugated paper tube; wherein each of the structural members is disposed between and attached to the first and second base pads.

In an embodiment of the corrugated paper structure, the structural members are disposed adjacent to the edges of the first and second base pads defining an interior volume for containing an item. In a preferred embodiment of the corrugated paper structure the structural members are attached to the first and second base pads by a cohesive composition applied to the members and the pads.

The invention also includes a method for packing an item comprising the steps of providing a first and second base pad of corrugated paper; providing a plurality of structural members of corrugated paper; attaching each of the plurality of structural members to the first base pad; placing the item on the first base pad between the plurality of structural members; and attaching the second base bad to the plurality of structural members.

In a preferred embodiment, the step of providing a plurality of structural members of corrugated paper further comprises the steps of providing a tube of corrugated paper with a rectangular cross-section; and providing a truss member of corrugated paper; and disposing the truss member diagonally within the tube and attaching the truss member to the interior surface of the tube.

DETAILED DESCRIPTION

The corrugated paper structure as described in reference to the embodiment depicted in the figures provides an improved structural design for use in corrugated paper packs, boxes, pallets and other corrugated paper structures. The corrugated paper structure has improved resistance to failure resulting from crushing, bending, breaking or other external forces.

Figure 1:
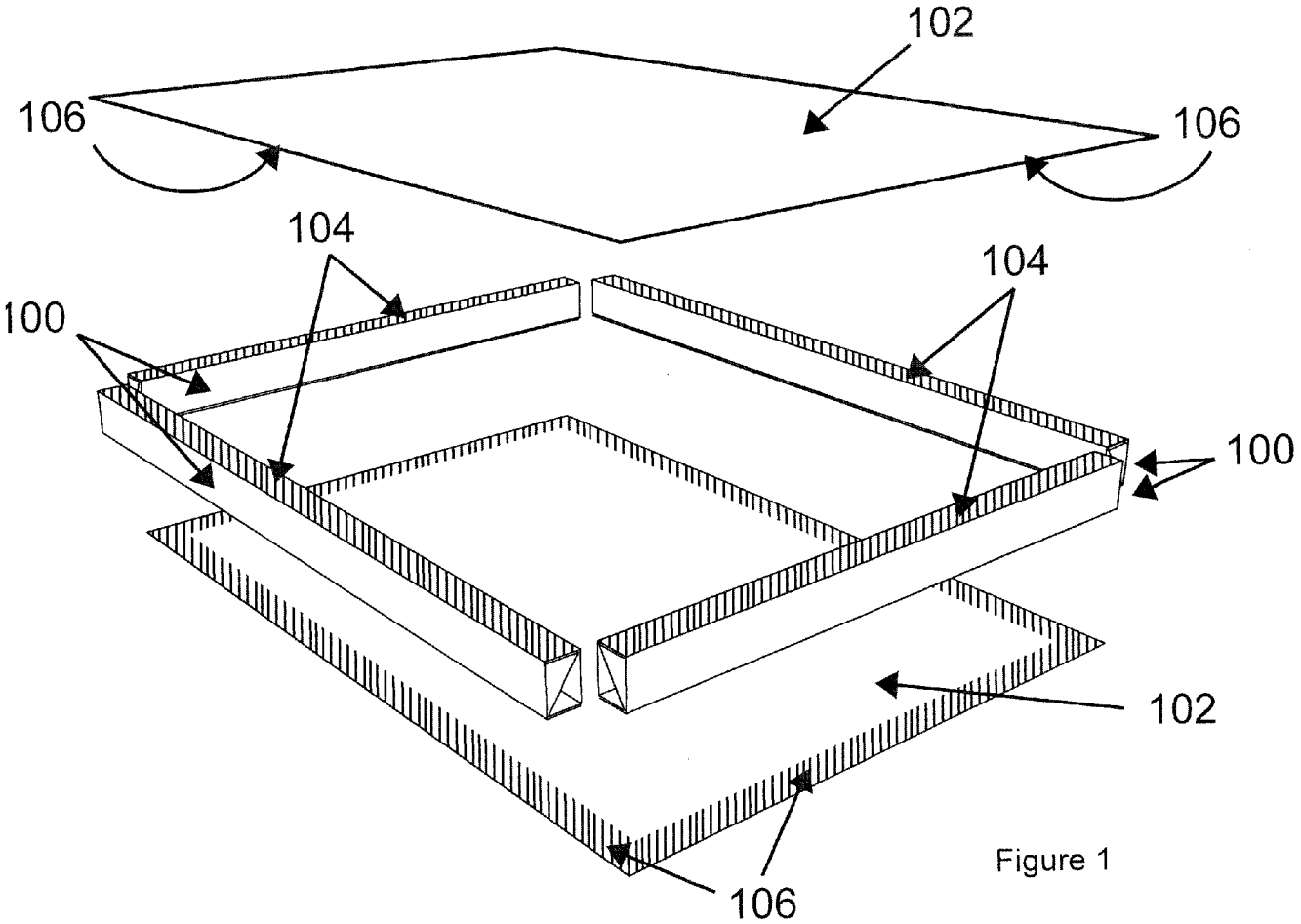
FIG. 1 is an exploded perspective view of an embodiment of the corrugated paper structure.

Referring now to FIG. 1, an exploded perspective view of an embodiment of the corrugated paper structure is depicted in use in a corrugated paper pack. The corrugated paper pack depicted in the figure comprises four structural members 100. Two pads 102 are provided for joining to the members 100 to form a pack for protecting and shipping an item. The bases 102 are attached to opposing sides of the members 100 defining an interior volume of the pack for containing the item to be protected.

The members 100 and pads 102 are formed from corrugated paper. The internal structure of members 100 is described in relation to later figures. Pads 102 are sheets of corrugated paper of appropriate size and thickness for the application.

The top and bottom surfaces 104 of members 100 are coated with a material to attach the members 100 to the pads 102. Similarly, areas 106 adjacent to the edges of pads 102 are coated with a material to attach to members 100. The materials may be glues, adhesives or other materials suitable for attaching two corrugated paper components together.

In a preferred embodiment of the corrugated paper structure, a cohesive material is utilized to coat the top and bottom surfaces 104 and areas 106. The cohesive materials may be applied to the areas, and once dried will cohere to each other when placed in contact, forming a permanent connection between the components. Cohesive materials used in a preferred embodiment do not adhere to other materials when dried, but instantly adhere to other coatings of the same material.

The cohesive materials are typically applied by rolling them onto a surface of a component and allowing them to cure or dry if necessary, though different materials may be sprayed on or applied as appropriate for a specific cohesive material. Once the cohesive materials have properly cured, become tacky or dried they are placed in contact with a coating of the same material on the surface of the other component, at which time the two coatings cohere and securely attach the two components together.

The corrugated paper structure members 100 may alternatively be attached to each other near the ends of each member, though in a preferred embodiment they are not attached to each other directly. In a preferred embodiment, the attachment to pads 102 described above is sufficient to secure the members 100 together in the desired configuration.

The specific size, shape and number of components shown in FIG. 1 is not limiting of the present invention. Other sizes and shapes of pad 102 may be utilized, such as triangular, hexagonal or other polygonal shapes. Similarly embodiments of the invention may utilize more or fewer members 100 than shown in FIG. 1, and the members 100 may be arranged in different configurations. Structures may be formed by attaching members 100 to other members to form taller sides to a structure, or structures may include multiple layers of members 100 and pads 102 to form structures as desired.

In some embodiments pads 102 may have holes, openings, or other perforations. Similarly, structures created according to the present invention may have multiple separate interior volumes defined by the pads 102 and the members 100. In other embodiments of the present invention, not all the edges, or portions of edges, of the pads 102 are attached to a member 100.

Figure 2:
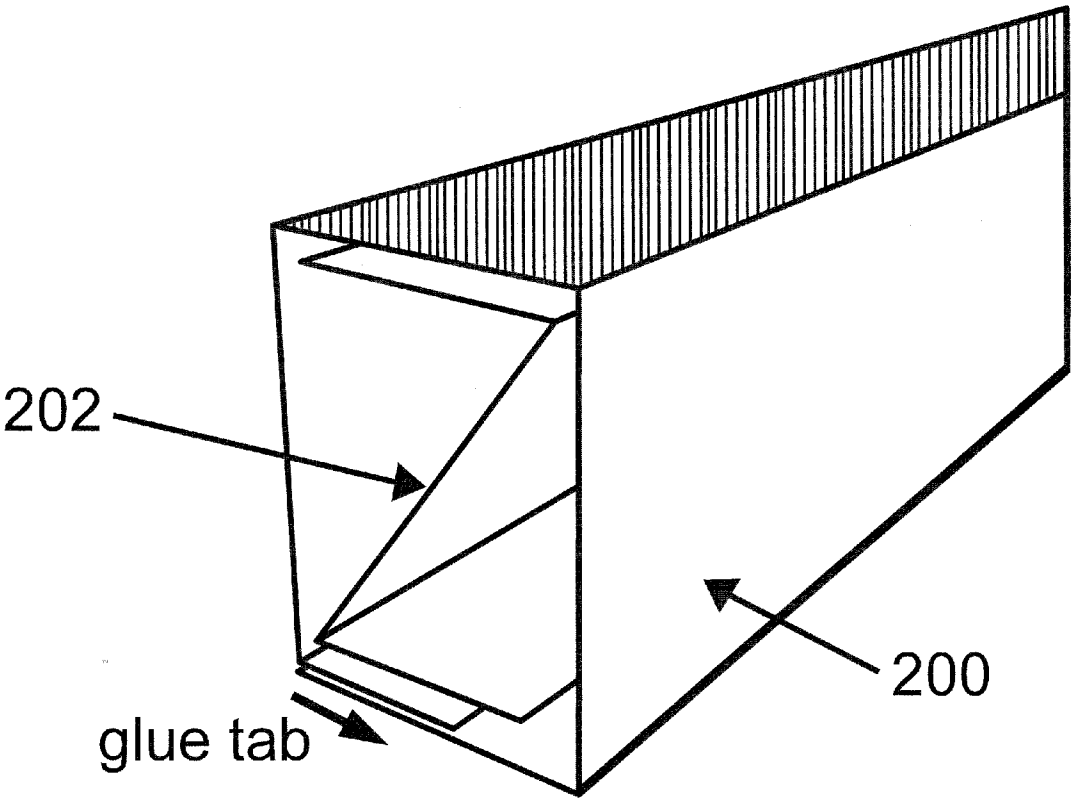
FIG. 2 is a perspective cross-sectional view of an embodiment of the corrugated paper structure.

Referring now to FIG. 2, a perspective cross-sectional view of an embodiment of the corrugated paper member 100 is depicted. The corrugated paper structure comprises a tube member 200 and a truss member 202. The tube member 200 is a tube with a rectangular cross-section formed from corrugated paper. In various embodiments of the corrugated paper structure the dimensions and cross-section of the tube member 200 vary as necessary for specific applications.

Figure 3:
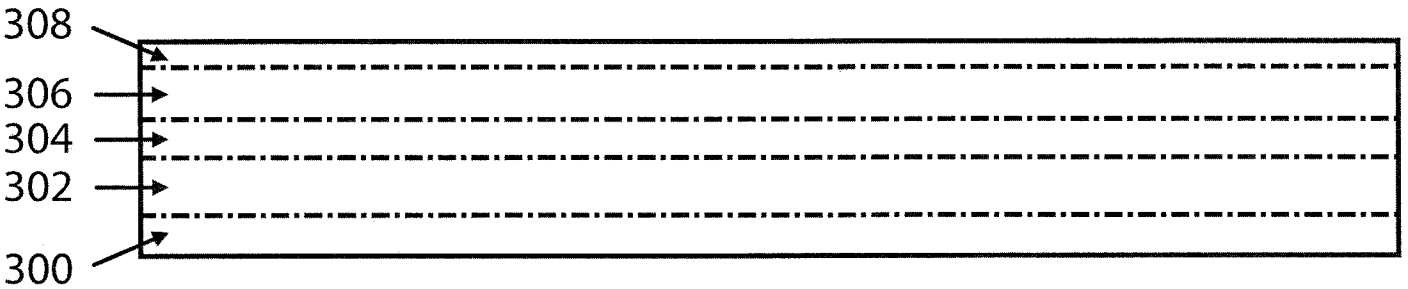
FIG. 3 is a top plan view of a component of an embodiment of the corrugated paper structure.

The tube member 200 is formed from a single sheet of corrugated paper. A top plan view of the corrugated paper sheet for an embodiment of the tube member 200 is depicted in FIG. 3. The flat sheet of corrugated paper may be of any size necessary to form a member 100 of the size necessary for a given application. In one embodiment of the present invention, the sheet of corrugated paper is 16½ inches by 96⅜ inches. In other embodiments the sheet may be of varying length and width. The sheet may be formed from varying weights and thicknesses of corrugated paper as necessary for a given application.

The flat sheet is scored or otherwise prepared for folding along its length to create sides 300, 302, 304, 306 and a glue tab 308, each running the length of the flat sheet. The sides are folded into a tube and secured by gluing the glue tab 308 to side 300 using standard techniques for processing corrugated paper. In a preferred embodiment of the present invention, the corrugation will be oriented across the width of the sheet from which the tube 200 is formed, perpendicular to the scoring for the sides and glue tab.

In an embodiment of the tube member 200, side 300 is 2⅞ inches wide, side 302 is 4⅜ inches wide, side 304 is 2 15/16 inches wide, side 306 is 4 5/16 inches wide and glue tab 308 is 2 inches wide. A tube formed from the described sheet has inside dimensions of 4 3/16 by 2¾ by 96⅜. In other embodiments, the sheet and resulting tube may have other dimensions as necessary for a given application.

Figure 4:
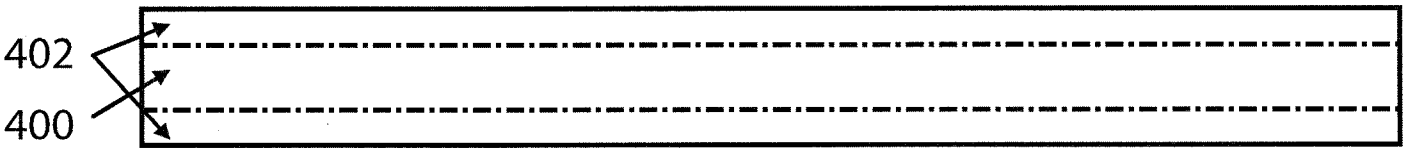
FIG. 4 is a top plan view of a component of an embodiment of the corrugated paper structure.

The truss member 202 is formed from a second sheet of corrugated paper. A top plan view of the corrugated paper sheet for an embodiment of the truss member 202 is depicted in FIG. 4. The sheet of corrugated paper may be of varying size so long as it is appropriately sized to be folded into a configuration that will fit inside the tube member 200. In one embodiment of the present invention the truss member 202, sized to fit the preferred embodiment of tube member 200 described in relation to FIG. 3, the sheet of corrugated paper for the truss member 202 is 10¼ inches by 96⅜. The sheet may be formed from varying weights and thicknesses of corrugated paper as necessary for a given application.

The truss member comprises a panel 400 that extends diagonally across the interior of truss member 200, from one corner thereof to the opposing corner. In the embodiment of the truss member 202 designed to be inserted into the embodiment of the tube member 200 described above, the truss member panel 400 is 4¾ inches wide. At each end of panel 400, a glue tab 402 is provided for attaching the truss member 402 to the tube member 200. In the depicted embodiment, glue tabs 402 are 2¾ inches wide. In other embodiments, the sheet and resulting truss may have other dimensions as necessary for a given application.

The truss member 202 is prepared by folding the flat sheet along the depicted lines into a Z shape. The folding of truss member 202 may be accomplished using typical methods known for processing corrugated paper. As part of the folding process or as a subsequent process, glue or adhesive is applied to the outer surfaces of glue tabs 402. The truss member 202 is then inserted into tube member 200 and the glue tabs 402 contact and bond with the inner surfaces of tube member 200.

In a preferred embodiment of the process, after applying the glue to the glue tabs 402, the glue tabs 402 are folded against or nearly against panel 400 of the truss member 202. The truss member 202 is inserted into the tube member 200. Once the truss member 202 is fully inserted into tube member 200, glue tabs 402 are released and expand to contact the interior of tube member 200. After curing the adhesive attachment between glue tabs 402 and the interior surfaces of tube member 200, the structural members 100 may be attached to pads 102 to form a corrugated paper structure.

Figure 5:
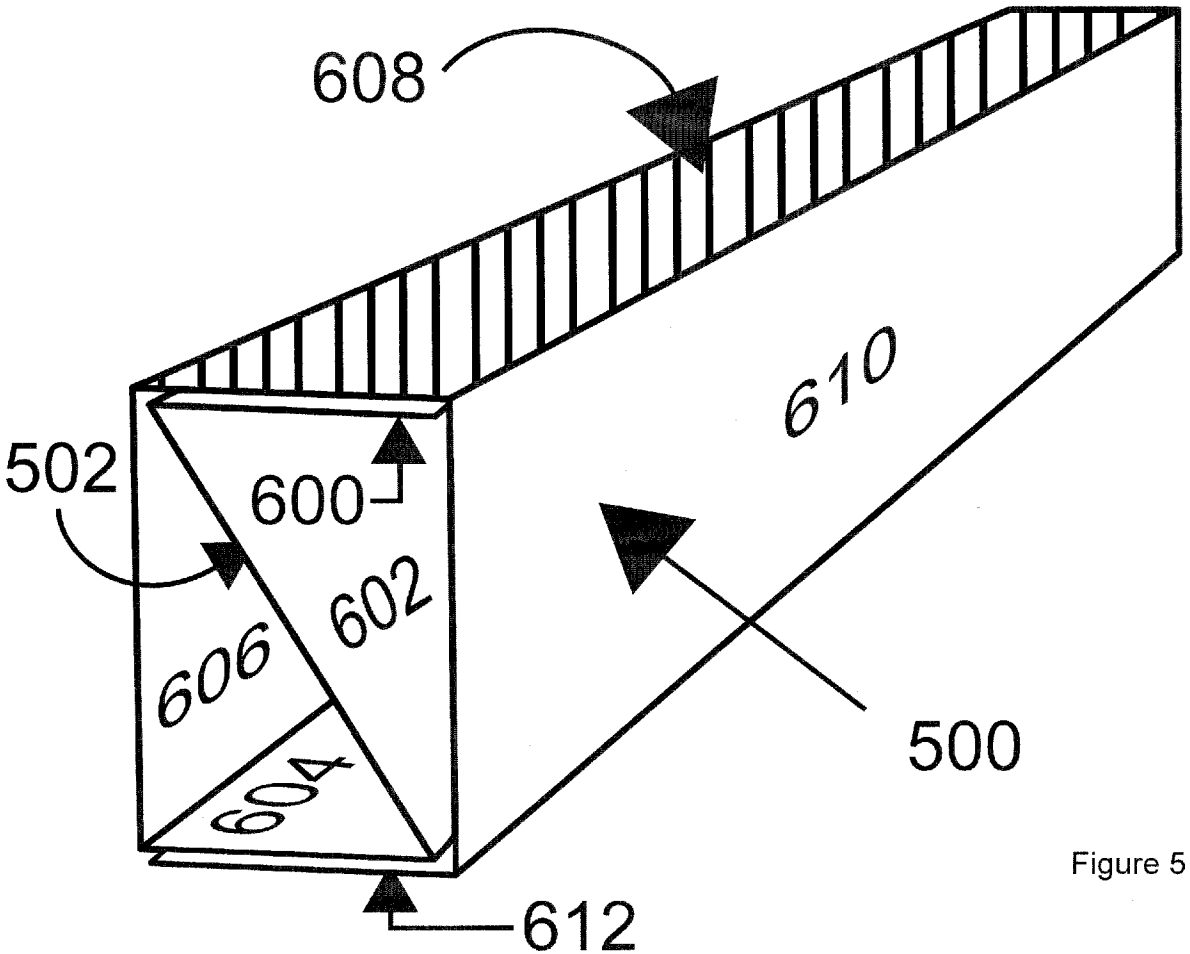
FIG. 5 is a perspective cross-sectional view of an alternative embodiment of the corrugated paper structure.

Referring now to FIG. 5, a perspective cross-sectional view of an alternative embodiment of the corrugated paper member 100 is depicted. The corrugated paper structure comprises a scored tube member 500 formed from a single sheet of corrugated paper. The tube member 500 is a tube with a rectangular cross-section and an internal truss 502 formed when folding the tube. In various embodiments of the corrugated paper structure the dimensions and cross-section of the tube member 500 vary as necessary for specific applications.

Figure 6:
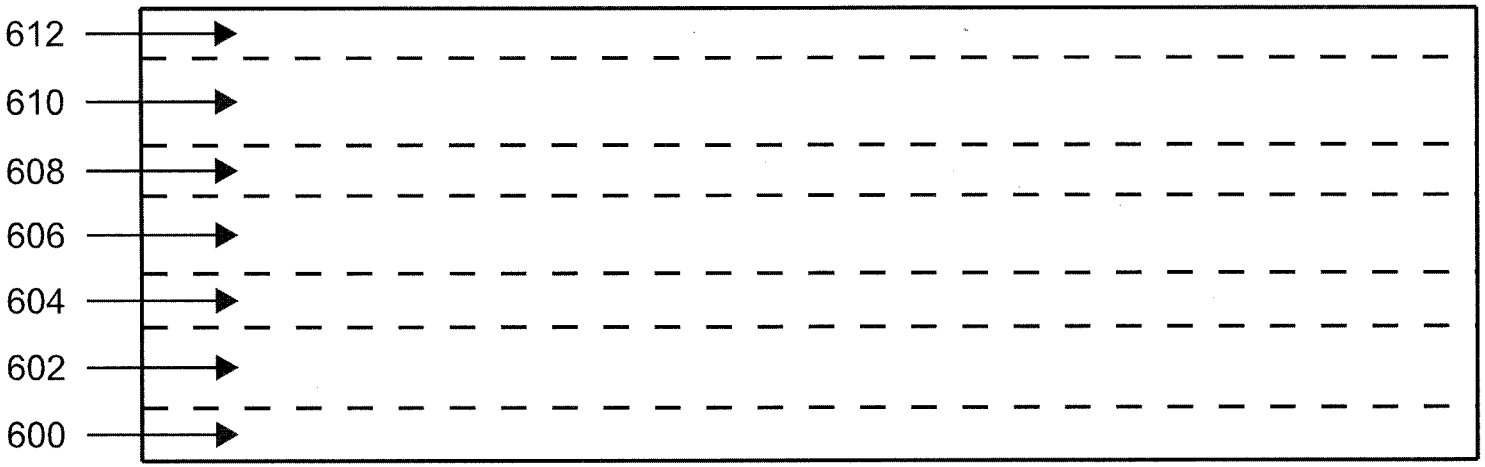
FIG. 6 is a top plan view of an alternative embodiment of the corrugated paper structure.

In the alternative embodiment depicted in FIG. 5, the tube member 500 and the truss member 502 are formed from a single sheet of corrugated paper. A top plan view of the corrugated paper sheet for an embodiment of the tube member 500 is depicted in FIG. 6. The flat sheet of corrugated paper may be of any size necessary to form a member 100 of the size necessary for a given application. In one embodiment of the present invention, the sheet of corrugated paper is 24⅝ inches by 96⅜ inches. In other embodiments the sheet may be of varying length and width. The sheet may be formed from varying weights and thicknesses of corrugated paper as necessary for a given application.

The flat sheet is scored or otherwise prepared for folding along its length and formed with side 600, and truss area 602 and sides 604, 606, 608, and 610 and a glue tab 312, each running the length of the flat sheet. The side 600 is folded back and truss area 602 and sides 604, 606, 608 and 610 are folded into a tube and secured by gluing the glue tab 612 to side 604 using standard techniques for processing corrugated paper. In a preferred embodiment of the present invention, the corrugation will be oriented across the width of the sheet from which the tube 500 and cross support 502 is formed, perpendicular to the scoring for the sides and glue tab.

In an embodiment of the tube member 500, side 600 is 2⅞ inches wide, side 602 is 4⅜ inches wide, side 604 is 2 15/16 inches wide, side 606 is 4¼ inches wide, 608 is 2¾ inches wide, 610 is 4¾ wide and glue tab 612 is 2 11/16 inches wide. In other embodiments, the sheet and resulting tube may have other dimensions as necessary for a given application.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A corrugated paper structure for containing and protecting an item from impact damage, comprising:

a first and a second rectangular base pad of corrugated paper;

four structural members, each member comprising a corrugated paper tube and only one corrugated paper truss member disposed within the corrugated paper tube;

wherein the corrugated paper tube is formed from a folded sheet of corrugated paper having a first, a second, a third and a fourth panel and a glue panel, each panel extending lengthwise along the folded sheet and folded perpendicularly to the adjacent panels to form a tube with a rectangular cross-section, and the glue panel is glued to the first panel;

and the only one corrugated paper truss member is formed from a folded sheet of corrugated paper having a truss panel and two glue panels, one on either side of the truss panel, each panel extending lengthwise along the folded sheet, and each glue panel folded at an acute angle to and in opposing directions from the truss panel;

wherein the corrugated paper truss member is disposed inside the corrugated paper tube so that the truss panel of the truss member extends diagonally between opposing corners of the corrugated paper tube, and the glue panels of the truss member are glued to the inside surfaces of the first and third panels of the corrugated paper tube; and wherein each of the four structural members is disposed between and attached to the first and second base pads adjacent to each of the four edges thereof and perpendicularly to the adjacent structural members.

2. The corrugated paper structure of claim 1 wherein the corrugated paper tube and the corrugated paper truss member are formed from a single folded sheet of corrugated paper and the glue panel of the corrugated paper tube is also one of the glue panels of the corrugated paper truss member.

3. The corrugated paper structure of claim 2 wherein the at least one structural members are attached to the first and second base pads by a cohesive composition applied to both the first and second base pads and the at least one structural member.

4. The corrugated paper structure of claim 1 wherein the corrugations of the corrugated paper tube and the corrugated paper truss member are oriented perpendicular to the folds between the panels thereof.

5. A method of using the corrugated paper structure of claim 1 to protect an item comprising the steps of:

adhering the structural members to the first rectangular base pad;

disposing an item to be protected upon the first rectangular base pad between the structural members;

adhering the second rectangular base pad to the structural members;

storing or shipping an item disposed within the corrugated paper structure;

allowing the structural members to absorb impact or crushing forces exerted on the item.

* * * * *